United States Patent [19]

Wesner

[11] 4,219,159

[45] Aug. 26, 1980

[54] FOAM DEVICE

[75] Inventor: Walter H. Wesner, Plantation, Fla.

[73] Assignee: The AFA Corporation, Miami Lakes, Fla.

[21] Appl. No.: 1,046

[22] Filed: Jan. 5, 1979

Related U.S. Application Data

[63] Continuation-in-part of Ser. No. 819,428, Jul. 27, 1977, abandoned.

[51] Int. Cl.[3] ..... B05B 7/30

[52] U.S. Cl. ..... 239/343; 239/428.5

[58] Field of Search ..... 239/333, 343, 370, 428.5, 239/432; 169/14, 15

[56] References Cited

U.S. PATENT DOCUMENTS

| | | | |
|---|---|---|---|
| 2,630,183 | 3/1953 | Foutz | 169/15 |
| 3,388,868 | 6/1968 | Watoon et al. | 239/432 X |
| 3,946,947 | 3/1976 | Schneider | 239/428.5 X |

*Primary Examiner*—Robert B. Reeves
*Assistant Examiner*—Gene A. Church
*Attorney, Agent, or Firm*—Stanley A. Marcus

[57] ABSTRACT

A very compact foam-generating element for use in conjunction with a trigger-actuated dispenser is characterized by its insensitivity to its manner of attachment to and adjustment on the dispenser and features a combination of foam forming means located upstream of an expansion chamber having a nozzle at its inlet and terminated downstream by screening means, the screening means, expansion chamber and nozzle cooperating to produce a tightly packed, fine textured foam of even consistency by extending the time of treatment of the semi prepared foam received from the foam forming means, the screening means meanwhile adding air and further breaking up the liquid. The foam forming means provides non-contact jetting of the liquid through an aspirating chamber into a foam forming chamber having a diameter or cross section that is substantially the same as that of the aspirating chamber. The diameter or cross section of the expansion chamber preferably is substantially larger than that of the foam forming chamber. In one embodiment the foam-generating element is adapted to fit over the nozzle of a trigger-type dispenser; in another embodiment the element replaces the nozzle altogether; and in further embodiments the element is incorporated within the molded structure of trigger-actuated piston type and bellows type dispensers to form integral foam dispensers.

30 Claims, 15 Drawing Figures

FOAM DEVICE

This application is a Continuation-in-Part of application Ser. No. 819,428, filed July 27, 1977, now abandoned; entitled FOAM DEVICE and claiming priority, pursuant to 35 U.S.C. 119, under application Ser. No. 34874/76, filed in Great Britain on Aug. 20, 1976.

BACKGROUND OF THE INVENTION

1. Field of the Invention

The invention relates to an element for use in conjunction with a liquid sprayer or dispenser and to improvements in liquid dispensers utilizing the same for causing the liquid product to be discharged in the form of a foam rather than in the form of a stream, spray or mist. The invention is particularly useful with dispensers of the trigger-actuated type or finger pump type such as those disclosed in British Pat. Nos. 917,135, 1,315,966, and 1,331,842 and in corresponding U.S. Pat. Nos. 3,061,202, 3,685,739 and 3,650,473, respectively.

2. Description of the Prior Art

Many different forms of liquid dispensing or spraying devices have been proposed in the prior art for dispensing or spraying a variety of liquid products in the field, garden and home. Trigger type forms of such devices typically include discharge in the form of a stream, spray or mist. Special nozzle apparatus attachments in the form of elongated tips have been proposed for use with such devices that are non-foaming but otherwise are complete for converting the liquid product discharge to the form of a foam, thereby to achieve the advantages of foam spraying. Such advantages include reduced spray drift, visual evidence of spray coverage, and adherence of the product for longer periods to the surface that has been sprayed. U.S. Patents disclosing such special foam-generating nozzle attachments are U.S. Pat. Nos. 4,013,228, 3,946,947 and 3,836,076.

Such prior art foam-generating nozzle attachments are characterized by their elongation, that is by a high length-to-diameter ratio and the provision at the interface of an aspirating chamber and a passage of substantially smaller cross section of a conical or tapered surface that is positioned to be struck or impinged upon by a diverging unaerated jet of liquid product to be foamed, the foaming action depending upon the pattern of or the angle of the diverging liquid jet.

The prior art foam-generating nozzle attachments leave something to be desired from the standpoint of operation, performance, and application. Specifically, the high length-to-diameter ratio of the prior art foam-generating nozzle presents handling problems, on an assembly line, in the shipping and distribution process, and in some consumer product applications, in terms of filling, packaging and using trigger-actuated dispensers having an elongated tip. Additionally, the elongated foam-generating nozzle attachment is sensitive to variations in the internal spray pattern, and hence, to its manner of attachment to and adjustment on the dispenser since the foam is produced by impacting the diverging jet stream on a tapered wall surface. The dispensing device with such attachment also requires more effort to operate than is desirable due to the length of the attachment and the introduction of air by aspirating into an unaerated stream of liquid product. This also undesirably limits the viscosity range of liquid products that may be successfully foamed. Moreover, the foam that is produced contains less air than is required for producing the tightly packed, even foam consistency that is most economical of the product that is being dispensed.

SUMMARY OF THE INVENTION

Among the objects of the invention is to provide an improved foam-generating element for use in conjunction with trigger-actuated liquid dispensers that avoids the afore-mentioned problems of the prior art foam-generating apparatus.

Another object of the invention is to provide such an improved foam-generating element that avoids the requirement of high length-to-diameter ratios of the prior art apparatus, and thus, advantageously, may be reduced substantially in length, and in some embodiments approximately by half.

A further object of the invention is to provide a very compact foam-generating element in which the overall dimensions are not critical and can be chosen to provide a foam of desired suitable quality.

A further object of the invention is to provide such an improved foam-generating element that is not sensitive to the manner of attachment of the element to the dispenser, nor to internal spray patterns of the liquid jet thereby enabling a wide viscosity range of liquid product to be successfully foamed.

Another object of the invention is to provide an improved foam-generating trigger-actuated dispenser or sprayer wherein the foam-generating element is incorporated within the confines of the mold structure of the dispenser.

In accomplishing these and other objectives, there is provided, according to a preferred form of the present invention, a very compact foam-generating element for use in conjunction with trigger-actuated piston and bellows type liquid dispensers that is characterized by its insensitivity to its manner of attachment to and adjustment on the dispenser and comprises a novel combination of:

(a) foam forming means including a foam forming chamber in advance of or on the upstream side of,
(b) an expansion chamber that receives foam from the foam forming chamber and configured to provide a nozzle at the inlet thereof, the diameter or cross section of the expansion chamber preferably being substantially larger than that of the foam forming chamber,
(c) screening means terminating the downstream side of the expansion chamber, and
(d) an outlet conduit for dispensing the foamed product, the diameter or cross section of said outlet conduit being substantially the same or larger than that of said expansion chamber.

It has been found that with a foam-generating element embodying this combination the length-to-diameter or cross section ratio may be low compared to the prior art foam-generating dispenser nozzle attachments. Thus good foam may be produced in a short axial distance. The screening means is believed to contribute to this result by acting as an impedment or obstacle to the flow of foamed product being forced through the screening means with each stroke of the dispenser trigger whereby an upstream rearwardly directed flow of foam is simultaneously formed adjacent the peripheral walls of the expansion chamber. This rearward flow of foam is subsequently reversed in direction and entrained in the central forwardly flowing portion of the foamed product by an injector effect provided by the aforementioned nozzle. A desirable effect of this action is an extension of the time of treatment of the semi prepared foam in the expansion chamber, the foaming action meanwhile being enhanced by a back or upstream flow of air that is drawn through the screening means. The quality of foam is thereby greatly improved. The larger diameter or cross section of the outlet conduit facilitates the movement of the foamed product therethrough. Accordingly, back pressure that tends to develop does not exceed a level at which an unacceptably high finger force would be required to stroke or reciprocate the trigger of the dispenser.

In accordance with the preferred form of the invention, the foam-generating element comprises a nozzle that is attached to the dispenser outlet head. Upon reciprocating the trigger of the dispenser, the liquid product to be foamed is forced as a jet stream or spray through an orifice associated with the dispenser outlet bore through foam forming means comprising an aspirating or air mixing chamber and a foam forming chamber, the spray fanning out and striking interrupter rings provided on intermediate and end portions of the inner surface or wall of the foam forming chamber. The foam forming chamber has a diameter or cross section, that is, substantially the same as that of the aspirating chamber. As the liquid spray fans out, after discharge from the orifice, and just prior to striking the interrupter rings, it is impinged upon by a plurality, four, for example, of columns of air that are drawn into the aspirating chamber through rectangular sharp edged slots that are spaced around the perimeter thereof. Preferably, the slots are wider at the outside diameter of the nozzle, where the air enters, and are narrower at the location of impingement. The wedge shape accelerates the air as it moved forward through the aspirating chamber. After this initial aeration of the spray or liquid product has begun, it is controlled and compacted in the foam forming chamber, being agitated and homogenized by the interrupter rings, and then passes into an expansion chamber having a diameter or cross section that is substantially larger than that of the foam forming chamber. From the expansion chamber the foamed product moves on through a screen into a turbo chamber where the foamed product is molded and directed to the target. The expansion chamber captures and entrains air with each stroke of the dispenser trigger and assists in providing a high quality foam. The screen facilitates this foaming action, acting as an obstacle to produce a circulating flow of foam within the expansion chamber that lengthens the time of treatment, meanwhile adding air and breaking up the liquid. The screen may have a variable mesh or porosity depending upon the chemical formulation of the liquid product and the type of foam to be delivered. Another screen or screens may be added to provide an additional means of adjusting the foam and volume of the foam produced.

Aeration of the liquid product, with this structure, is obtained in a plurality of ways. First, fluid product from piston and bellows type sprayers already contains some air. In addition, the structure makes use of a back flow of air through the foam-generating element screen. Also, as described, air is aspirated into the structure through slots. Depending upon the liquid being dispensed and the type of foam desired, however, it has been found that the aspiration slots may be dispensed with and a satisfactory foam still obtained. When aspiration slots are required, they consist desirably of a converging section, as described, with a sharp edge orifice. This increases the velocity of the air stream and creates turbulence at the sharp edge orifice, thereby effecting more intimate mixing of the air with the liquid product being dispensed, resulting in a foam that contains more air. As a result, the foam-generating element is more economical of the liquid product in covering the surface to be sprayed.

According to a preferred embodiment of the invention, the head portion of the dispenser including the discharge orifice thereof is made an integral part of the foam-generating element or unit whereby such head portion on the dispenser may be eliminated. In another embodiment of the invention, the foam-generating element does not include the dispenser head portion but is made to fit over and cooperate with the head portion already provided on the dispenser. According to this latter embodiment, the interrupter rings on the interior wall of the air mixing passageway are not utilized, an additional foam facilitating screen being provided, instead. With each of the described embodiments of the invention, it is noted that the foam-generating element is insensitive to the pattern of the liquid spray that is issued from the orifice, and hence, is insensitive to the manner of attachment to and adjustment of the element on the dispenser.

In further embodiments of the invention the novel foamgenerating element is incorporated within the body portion or molded structure itself of a trigger-actuated dispenser or sprayer whereby the physical dimensions of the dispenser with the foam-generating capability are essentially the same as a dispenser providing a discharge in the form of a stream, spray or mist.

DESCRIPTION OF THE EMBODIMENTS OF FIGS. 1-3 AND 4-7

Figure 1:
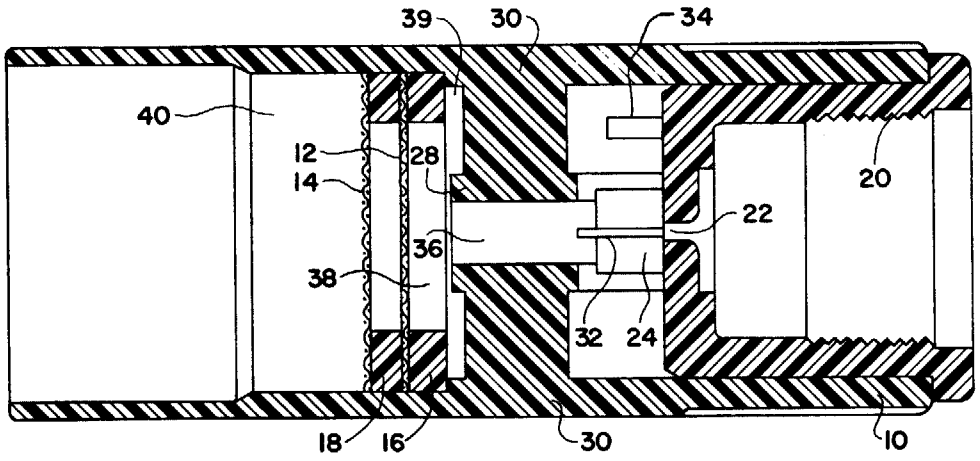
FIG. 1 is a longitudinal sectional view of the embodiment of the foam-generating element of the invention, taken along the line 1—1 of FIG. 2.
Figure 2:
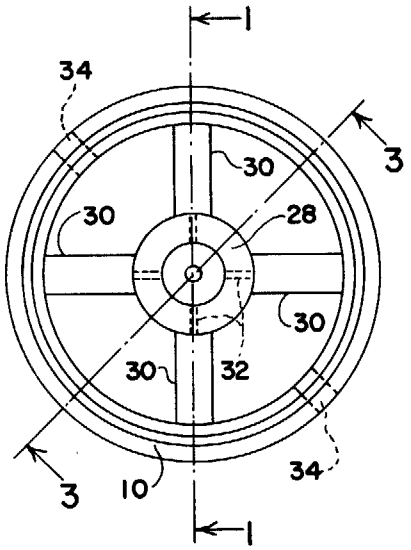
FIG. 2 is a view of the FIG. 1 embodiment as seen from the left, that is, from the foam discharge end thereof, with the screen elements and screen holders removed.
Figure 3:
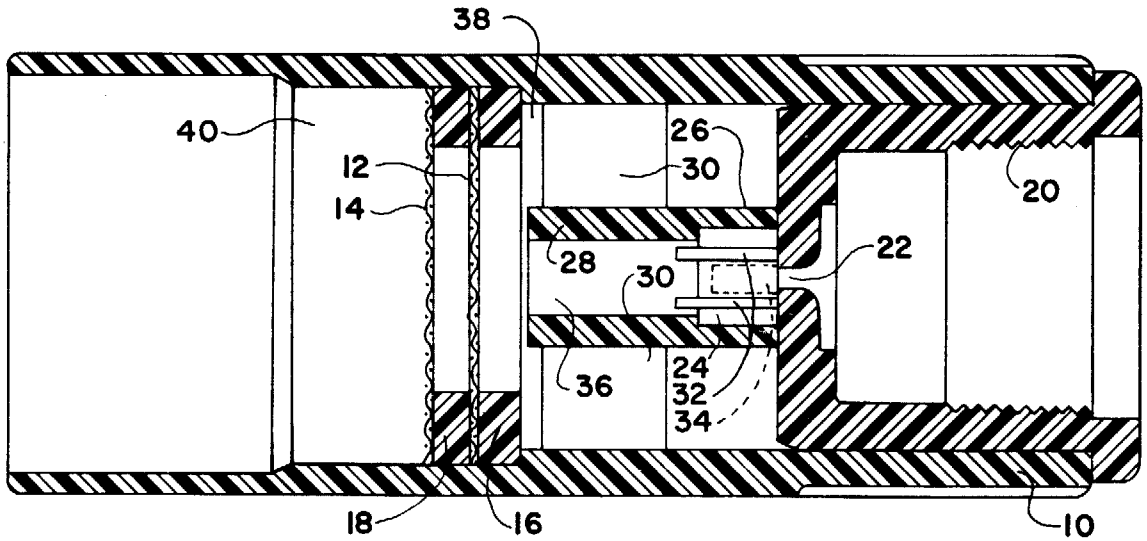
FIG. 3 is a longitudinal sectional view of the FIG. 1 embodiment, taken along the line 3—3 of FIG. 2.

The foam-generating element of the invention illustrated in FIG. 1-3 is particularly useful for effecting the conversion to foaming type sprayers of non-foaming trigger type piston pump dispensers or sprayers such as those shown in U.S. Pat. Nos. 3,061,202, 3,685,739 and 3,650,473. In such use the foam-generating element is adapted to be directly attached to the nozzle element of the dispenser, as for example, by a friction fit. The foam-generating element thus comprises an extension of the dispenser nozzle element.

In another embodiment of the invention, illustrated in FIGS. 4-7, the foam-generating element includes, as an integral part, the head portion of the dispenser, including the discharge orifice thereof, that replaces the dispenser head portion thereby eliminating the latter as a separate part. The nozzle end of the foam-generating element of this embodiment is internally threaded for facilitating attachment thereof to the dispenser.

Referring now to FIGS. 1-3, the numeral 10 indicates an outer shell or body of generally cylindrical form. Provided within body 10 are two screens or screen elements, indicated at 12 and 14, that are secured in place by two screen holders 16 and 18, respectively. Body 10 is adapted to be secured to the head portion, indicated at 20, of a trigger type dispenser, which dispenser is arranged to deliver a liquid product via an orifice 22. Also provided within body 10 is an aspirating chamber 24 of generally cylindrical shape. Chamber 24, as seen particularly in FIG. 3, is formed within the projecting end 26 of a tubular member 28 that is disposed coaxially with body 10, being integral therewith, and is supported centrally thereof by four spaced struts 30. The axis of the orifice 22 and the jet stream issued therefrom is coincident with the axis of the body 10, aspirating chamber 24 and tubular member 28. Four aspirating slots 32 that are spaced 90° apart, and each of which has a rectangular cross section, are formed in the wall of the projecting end 26 of tubular member 28. Slots 32 cooperate with two slots 34 of rectangular cross section that are located, diametrically opposite each other, in the wall of body 10 and are provided to introduce air from the atmosphere into the conical spray of liquid product that is admitted into and moves through the chamber 24 from the nozzle orifice 22. To that end the projecting end 26 of tubular member 28 is positioned in close abutting relation with the nozzle 20 with the orifice 22 disposed centrally thereof. The tubular member 28 is also provided with a foam forming cylindrical chamber 36 that is coaxial with aspirating chamber 24. Chamber 36 has a diameter or cross section somewhat less than that of chamber 24 and opens into, in abutting relation with, a relatively short expansion chamber, a third coaxial chamber 38 of substantially larger diameter or cross section and having a portion 39 at that end thereof that extends rearwardly of chamber 36 in encircling relation therewith, thereby providing a nozzle at the inlet to chamber 38. The other end of chamber 38 is defined by screen elements 12 and 14. A fourth coaxial chamber having a length and cross section greater than that of chamber 38 follows the screen elements 12 and 14.

Referring to FIGS. 4-7, the reference numeral 42 indicates an outer shell or body of a foam-generating element. Body 42 is of cylindrical form and may or may not be tapered in the manner shown as desired. At each end, body 42 defines a generally cylindrical opening. One opening, generally indicated at 44, is internally threaded and is adapted for attachment of the body to a dispenser or sprayer, thereby eliminating the separate element illustrated by numeral 20 in FIGS. 1 and 3. The other opening indicated at 46 is the discharge opening of the foam-generating element and defines a cylindrical chamber 48 that is coaxial with the cylindrical opening 44. Chamber 48 molds the foam and directs it to its target. The other end of chamber 48 terminates with a screen 50 that is interposed between chamber 48 and a coaxial expansion chamber 52 having a cross section smaller than that of chamber 48. Chamber 52 has a substantially larger diameter or cross section than that of an abutting coaxial foam forming chamber indicated at 54 and includes a portion 53 that extends in encircling relation to chamber 54, thus providing a nozzle at the inlet to chamber 52. Foam forming chamber 54, formed in one end of a tubular member 56 that is integral with body 42, is generally cylindrical and contains one or more interrupter rings 58. Tubular member 56 is disposed coaxially with respect to body 42 and is supported in integral manner therewith by struts 60. Rings 58 are constrictions that are formed in the internal wall surface of the chamber 54 and function to agitate and homogenize the foam entering from an aspirating coaxial chamber indicated at 62. Chamber 62 being closed by a transverse wall 64 of body 42. An orifice 66 is formed in wall 64, being centrally located with respect to chamber 62. Communicating between chamber 54 and orifice 66, chamber 62 is optionally provided with one or more wedge-shaped aspirating slots 68 through which air is drawn from the atmosphere into aspirating chamber 62 by the movement of liquid therethrough. Chamber 62 abuts orifice 66 through which liquid is forced by the dispenser. The axis of the orifice 66 and the spray issued therefrom is coincident with the axis of body 42 and chambers 62, 54, 52 and 48.

OPERATION OF THE EMBODIMENTS OF FIGS. 1-3 AND 4-7

The foam producing or generating elements of the invention are simple to fabricate and are effective in generating foam. The element illustrated by FIGS. 1-3 is fabricated in five parts, namely body 10, screen holders 16 and 18, and screens 12 and 14. The element illustrated by FIGS. 4-7 is fabricated in two parts, specifically body 42 and screen 50. The manufacture of molds for the production of body members 10 and 42 is a straightforward proposition and presents no difficulties. Similarly, insertion of holders 16 and 18 and screens 12 and 14 in the element of FIGS. 1-3 and the insertion of screen 50 in the element of FIGS. 4-7 are also straightforward. Screen 50 is conveniently fastened to body member 42 in any convenient manner and, where the screen and body member 42 are of the same material, such as polypropylene, attachment is readily effected by sonic welding.

Turning to the foam-generating element of FIGS. 1-3, foam is dispensed by actuating a convenient dispenser, for example, by reciprocating the trigger of a trigger-type dispenser in conventional manner. The liquid product is discharged from the trigger-type dispenser, and enters the foam-generating element via orifice 22 into aspirating or aerating chamber 24 where the liquid is intimately mixed with air brought in through slots 32. The motion of the liquid creates an aspirating action, causing preliminary foaming to take place in chamber 24. The foam moves into foam forming chamber 36 which has a diameter somewhat smaller than that of chamber 24. Foam forming chamber 36 compresses the foam, providing a finer textured foam and accelerates the movement of the foamed product.

From foam forming chamber 36, the foam moves on into and through expansion chamber 38 and impinges on screens 12 and 14 which act as obstacles to produce rearwardly directed flows of foam, extending the time of treatment of the foam in the expansion chamber and producing a back flow of air through the screen thereby greatly facilitating and enhancing the foaming action. There should be at least one and possibly as many as three screens. The expansion chamber 38 and screens 12 and 14 facilitate foaming, tending to add air and break up the liquid. With three or more screens the back pressure becomes considerable and it might take an unacceptably high amount of pressure to operate the trigger-type dispenser. Where two screens are used, they should be spaced apart, at least 0.031 inches (0.0787 cm) to facilitate the formation of a fine textured foam. If the screens are too close, they perform like a single screen, while if the screens are too far apart, the flow of foam is slowed and the foam can begin to break down before it has passed through the foam-generating element.

On passing through the screens, the foam passes through chamber 40 where the foam is finally molded and directed to the target.

The character of the foam produced, that is, wet or dry, is primarily a function of the air to liquid ratio and is generally governed by the liquid flow through orifice 22, the amount of air coming in through slots 32 and the size of aspirating chamber 24. Where the trigger-type dispenser has an adjustable nozzle, the adjustment usually provides a stream of liquid or a spray. This adjustment is a convenient means for governing the type of foam. Where the nozzle is set for a spray, the liquid entering chamber 24 from orifice 22 tends to spread or flare. The ratio of air to liquid in chamber 24 is therefore relatively high and the resulting foam tends to be drier and creamier. Where the dispenser nozzle is set for a stream, the liquid entering chamber 24 through orifice 22 tends to be compressed and the ratio of air to liquid in chamber 24 is relatively lower; the foam produced tends to be wetter, having less air entrained therein. Wetter foam can generally be projected further than a dry, creamy foam.

FIGS. 4–7 present a preferred embodiment of the foam-generating element of the invention. The foam-generating element illustrated by FIGS. 4–7 is fabricated in two parts, the body 42 and the screen 50; hence, its assembly is extremely simple. As previously indicated, this embodiment is intended to replace the adjustable nozzle of a trigger-type sprayer and is intended to be fastened to such a sprayer in place of the nozzle. Upon reciprocating the trigger of the trigger-type sprayer, liquid is forced in the form of a spray through orifice 66 into aspirating or aerating chamber 62. As the liquid spray fans out and prior to striking interrupter rings 58 in foam forming chamber 54, it is impinged upon and aerated by columns of air entering through slots 68. The aerated liquid product moves into foam forming chamber 54, striking interrupter rings 58 which agitate and mix the foam. From foam forming chamber 54, the foam moves on through expansion chamber 52 and screen 50 into chamber 48 where it is shaped and directed to the target. Expansion chamber 52 and screen 50 cooperate, as described, greatly to facilitate and enhance the foaming action thereby to produce high quality foam, and moreover, to permit such production with a foam-generating element body 42 of substantially reduced length. The ability of expansion chamber 52 to capture and entrain air with each stroke of the dispenser trigger is believed to be significant to the ability of the foam-generating element of the embodiment of the FIGS. 4–7 to effectively function without aspirating slots 68.

The foam-generating element embodiments of the invention described herein by reference to FIGS. 1–7 can be fabricated of any convenient thermoplastic material such as polyolefin, including polyethylene and polypropylene, acrilonitrilebutadiene styrene, polyamide, polystyrene, polyvinylchloride, polyvinyl acetate, polyvinylbutyral, and the like. For reasons of ease of fabrication and cost, polypropylene is preferred.

The screen or screens of each embodiment can be of any convenient and useful material whether woven or non-woven, natural or synthetic; the particular type being selected to provide a foraminous product yielding the desired foam and having a reasonable service life. The screens can be of fine mesh metal or synthetic plastic or can be formed of porous synthetic material where the pores are formed by foaming or other methods known to the art. The pores in the screens employed can be of any convenient size and configuration to produce foam of the desired character.

In connection with the production of foam it should be noted that the foam-generating elements described herein obtain air in a variety of ways. The structural arrangement makes use of the fact that liquid product from a trigger-type dispenser or sprayer already contains some air, makes use of the backflow of air through the screen, and finally, makes use of air introduced through air passages such as air slots 68 thereof. In many cases, air slots 68 can be eliminated.

Another advantage of the foam-generating element invention described herein is that foam is generated in a structural arrangement that compared to the prior art foam-generating elements, is very compact. The structure does not require high length to diameter or cross section ratios and it is thus possible to provide a foam-generating element that is extremely compact. An element approximately one-half the length of the prior art foam-generating elements is feasible. This aspect of the invention is particularly advantageous when consumer product applications and the consequent problems of packaging and shipping are considered.

Additionally, the structural design is not sensitive to internal spray patterns, permitting a wide viscosity range of materials to be successfully foamed. The element will foam virtually any liquid that can be dispensed in a hand-operated trigger-type dispenser and that contains a surfactant.

The overall dimensions of the foam-generating elements of the invention are not considered to be critical and can be varied to provide a suitable foam. Dimensions of one embodiment of the element illustrated by FIGS. 4–7 that provides an overall length to diameter ratio of approximately 3 to 1 are as follows: the overall length is approximately 1.85 inches (4.70 cm); with the length of the portion attached to the trigger sprayer (the length from the end of the opening 44 to the outlet orifice 66) being approximately 0.56 inches (1.425 cm), and the length from the end of orifice 66 to the centerline of interrupter rings 58 being approximately 0.25 inches (0.635 cm). The distance between the centers of the interrupter rings 58 is approximately 0.125 inches (0.318 cm). The distance between the end of orifice 66 and the end of foam forming chamber 54 is approximately 0.41 inches (1.0414 cm), and the distance from the end of outlet orifice 66 to screen 50 is approximately 0.5 inches (1.27 cm). The distance from the end of outlet orifice 66 to the end of the discharge opening 46 is approximately 1.25 inches (3.18 cm).

Figure 4:
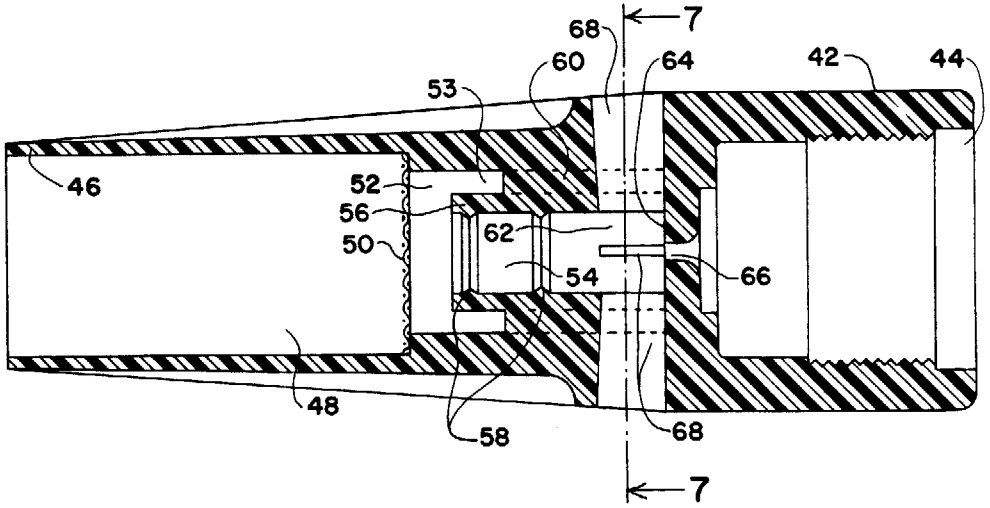
FIG. 4 is a longitudinal sectional view of a preferred embodiment of the foam-generating element of the invention, taken on the lines 4—4 of FIG. 5.
Figure 5:
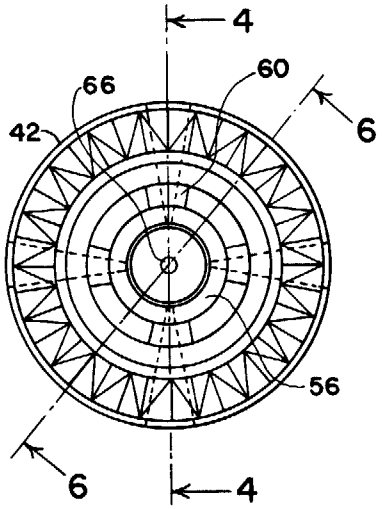
FIG. 5 is a view of the foam-generating element of the FIG. 4 embodiment as seen from the left, that is from the foam discharge end, with the screen element removed.
Figure 6:
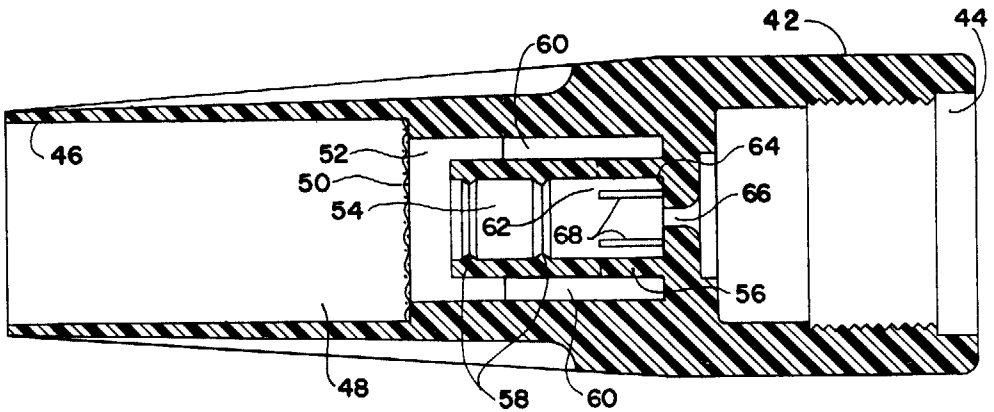
FIG. 6 is a longitudinal sectional view of the FIG. 4 embodiment taken along the line 6—6 of FIG. 5.
Figure 7:
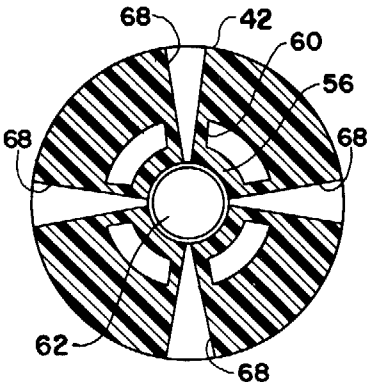
FIG. 7 is a sectional view of the FIG. 4 embodiment, taken along the line 7—7 of FIG. 4.

Aerating or aspiraing chamber 62 and foam forming chamber 54, as shown in FIGS. 4 and 6, have a diameter of approximately 0.16 inches (0.4064 cm) while the thickness of the wall of chamber 54 is 0.04 inches (0.102 cm). Expansion chamber 52 has an inner diameter of approximately 0.28 inches (0.711 cm). Foam finishing chamber 48 has an inner diameter of 0.375 inches (0.953 cm).

While the foam-generating invention embodiments described herein in FIGS. 1-7 have been described as applicable to a trigger-type dispenser or sprayer, it will be understood that they can be used with a finger pump type dispenser or sprayer as well. Further, while the foam-generating embodiments have been described in terms of a separate element that is attachable to the outlet or discharge end of an otherwise complete non-foaming trigger-type dispenser, it is contemplated that the foam-generating element can be incorporated within the confines of the mold structure of a trigger-type dispenser or sprayer to provide an integral foam dispenser or sprayer. Embodiments of this aspect of the invention are illustrated and described by reference to FIGS. 8-15.

DESCRIPTION OF THE EMBODIMENTS OF FIGS. 8-15

Figure 8:
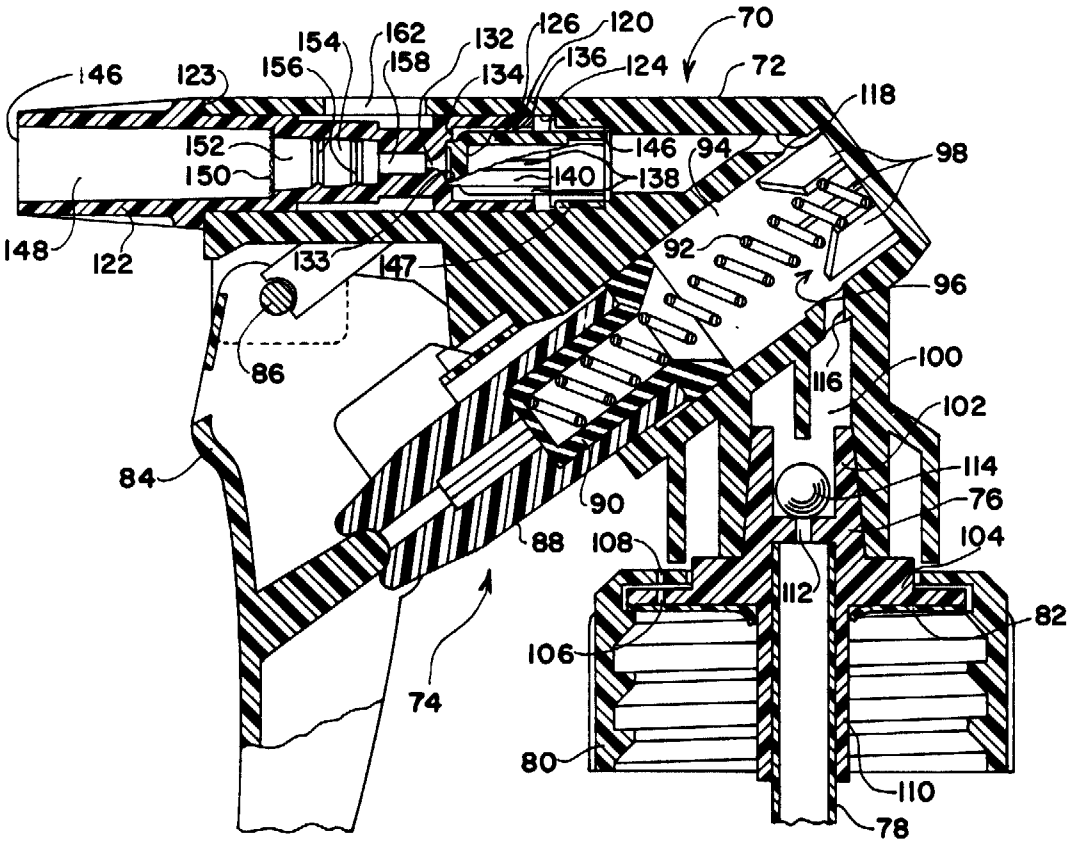
FIG. 8 is a sectioned view of a trigger actuated piston pump dispenser or sprayer incorporating within the confines of the molded structure thereof a modified form of foam-generating element.
Figure 10:
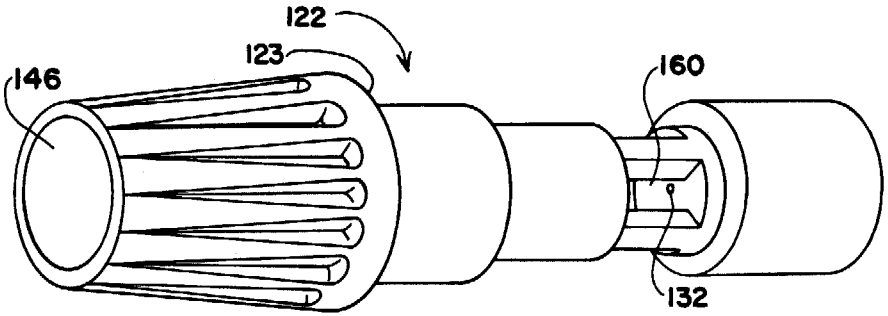
FIG. 10 is a perspective view illustrating the foam-generating element of FIG. 8.
Figure 11:
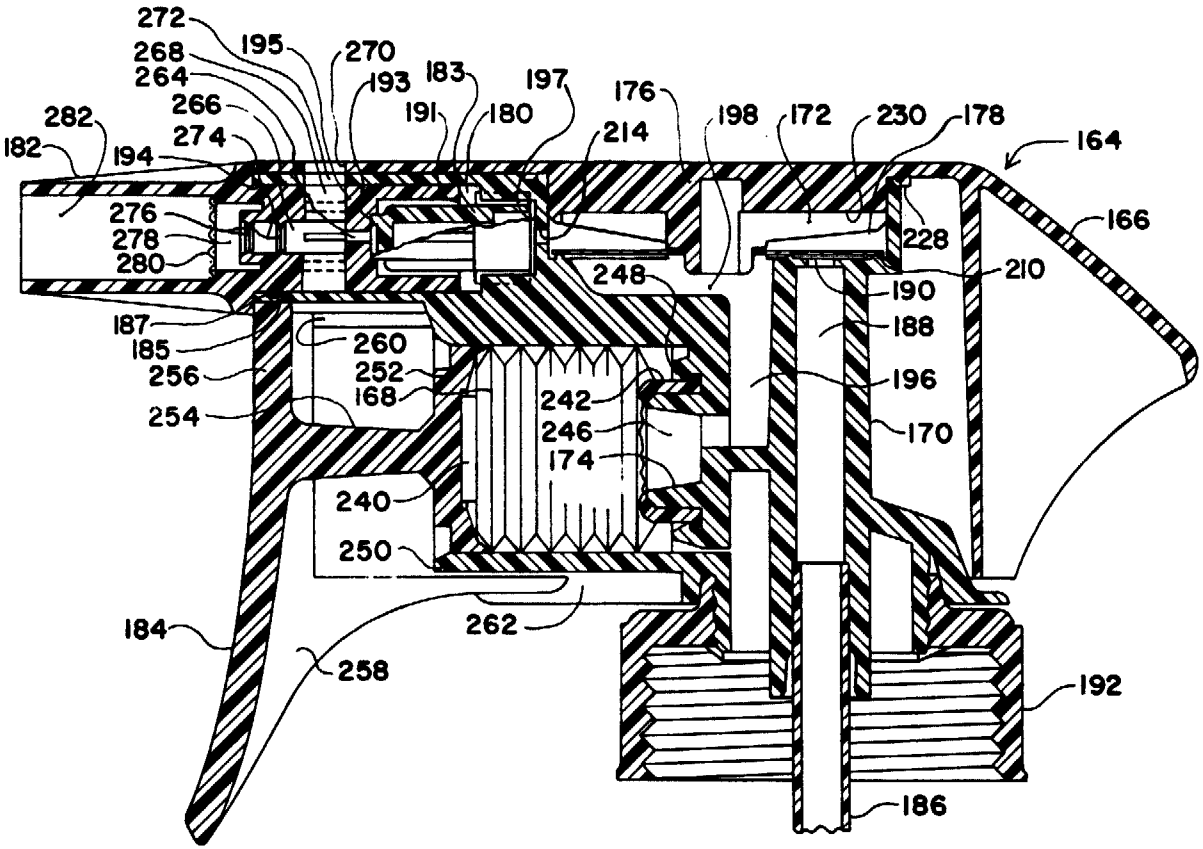
FIG. 11 is a sectional view of a trigger-actuated bellows pump dispenser or sprayer incorporating within the confines of its molded structure the preferred form of foam-generating element as illustrated in FIGS. 4–7.

Two different forms of foam dispensers are illustrated, one utilizing a piston type pump, as shown in FIG. 8, and the other a bellows type pump, as shown in FIG. 11. FIG. 8 embodies within its structure a modified version of the foam-generating element according to the present invention, such element being shown in cross section in FIG. 8 and in perspective in FIG. 10.

Specifically, FIG. 8 shows a dispensing device 70 including a body component 72, a trigger lever actuated piston type pump mechanism 74, an inlet or intake stem 76, a dip tube 78, a bottle cap 80, a conical seal 82 and a trigger 84 supported on body 72 by a pin 86. The bottle cap 80 threads on to the upper end of a container (not shown) of liquid product to be foamed. While a shroud or fairing is not shown as associated with the body 72 of dispenser 70, it will be understood that such a shroud may be provided, being formed integrally with the body 72, if desired, or separately provided as disclosed in the copending application of J. R. Cary and W. H. Wesner bearing Ser. No. 881,998, filed Feb. 28, 1978.

The pump mechanism 74 may be of any of the known types available in the art, but for purposes of illustrating an operative embodiment of the present invention, it may be and has been shown as of the type disclosed in U.S. Pat. No. 3,685,739, aforementioned. The pump mechanism 74 includes a hollow piston 88 containing a rubber or flexible cup-shaped piston washer 90, and a piston reaction spring 92 mounted within a chamber or cylinder bore 94 formed in body 72. Piston 88 together with washer 90 acts as a two-piece piston.

One end of spring 92 is confined within a spring cage 96. Spring cage 96 is comprised of a plurality of circumferentially spaced, inwardly extending, radial fins 98 that are formed integrally with body 72, in the wall of a chamber or cylinder bore 94 adjacent the inner wall thereof. The other end of spring 92 seats within washer 90 which forms part of piston 88.

The body 72 is formed with a conical cavity 100 into which is pressed the upper and mating conical end 102 of intake stem 76 thereby to securely fix the stem 76 to the body 72. A flange 104 on the lower end of stem 76 abuts against the lower end of the wall of cavity 100. The dip tube 78 is press fit in intake stem 76. Dip tube 78 extends into the container previously mentioned but not shown and desirably extends to a position adjacent the bottom thereof. The outer circumferential edge of seal 82 is compressed between the flange 104 and the top surface of the neck of the container so as to effect a tight seal therebetween.

A small vent opening 106 provided in flange 104 communicates with a vent opening 108 in the cap 80. Air is drawn into container from the atmosphere through these vent openings, past the inner circumferential edge of conical seal 82, during the suction stroke of the two-piece piston 88, 90. Conical seal 82 acts as a check valve, permitting air to be drawn into the container through vent openings 106 and 108 but preventing the reverse flow of air from the container by sealing against a depending stem 110 of flange 104. Seal 82 serves an additional function as a washer for effecting a liquid tight seal between flange 104 and the outlet of the container.

Intake stem 76 is provided with an opening 112 adjacent the upper end of dip tube 78. Opening 112 is controlled by a ball check type valve 114 which allows liquid to be drawn upwardly through the dip tube 78 and opening 112 into the conical cavity 100 but prevents reverse flow of liquid from cavity 100 through opening 112 into the dip tube 78. Cavity 100 communicates through an opening 116 in body 72 with the cylinder bore 94.

Figure 9:
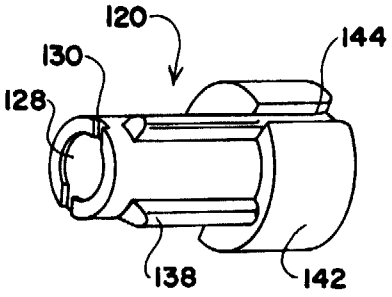
FIG. 9 is a perspective view of an outlet check valve and spinner member employed in the sprayer of FIG. 8.

A conduit 118 in body 72 provides communication between cylinder bore 94 and a combination check valve and spinner member 120 and a foam-generating element 122. Member 120 and element 122 are positioned end-to-end in an outlet bore 124 provided in body 72, with element 120 positioned adjacent conduit 118 and partially inserted in the adjacent end of element 122. Elements 120 and 122 are tubular in form, element 122 being press fit in outlet bore 124 with a shoulder 123 in engagement with the outer end of the outlet bore 124. Perspective views of member 120 and element 122 are shown in FIGS. 9 and 10, respectively.

The combination check valve and spinner member 120 is in the form of a cup or cylinder that preferably is molded from a suitable plastic as an integral unit. Element 120, as shown, is closed at one end by a wall 126 and is open at the other end. The outside face of end wall 126, as seen in FIG. 9, is provided with a circular cavity 128 and a pair of tangential slots 130 which extend from cavity 128 to the outer periphery of element 120. Cavity 128 communicates with an orifice 132 that is formed in an internal transverse wall 134 provided within foam-generating element 122, the member 120 extending into the element 122 through a cylindrical opening 136. The outer face of the closed end 126 of member 120 is flat so that when in its extreme position to the left, as seen in FIG. 8, member 120 effects a liquid tight seal against a depressed surface 133 formed on the adjacent wall 134 of element 122, thereby forcing the liquid pumped through conduit 118 by pump 74 to pass through the tangential slots 130 of element 120 into cavity 128 and on through orifice 132 of foam-generating element 122.

Check valve and spinner member 120 further is provided with a plurality of circumferentially spaced ribs 138 and a cylindrical portion 142 and is freely slidable within the cylindrical opening 136 of element 122 and within the outlet bore 124. Ribs 138 slide upon the internal cylindrical walls of cylindrical opening 136 and provide passageways 140 through which liquid can pass from conduit 118 around the outside of member 120. The open end portion 142 of member 120 is larger in diameter than the ribbed portion thereof and includes a pair of circumferentially spaced radial slots 144 which communicate with passageways 140 and the space between the enlarged end of member 120 and the interior wall of outlet bore 124. Slots 144 also cooperate with projecting ribs 147 that are provided in the interior wall of outlet bore 124 to prevent rotation of but to allow sliding movement of member 120 in outlet bore 124. The open end face of member 120 is flat so that it makes a liquid tight seal with a circular inner end wall 146 of outlet bore 124 when member 120 is in its extreme position to the right.

In the operation of the dispensing device 70, when trigger 84 is manually squeezed to force the two-part piston 88, 90 inwardly of cylinder bore 94, air in the cylinder bore 94 is compressed to cause member 120 to slide to the left to the position shown in FIG. 8 to seat against the face 133 of wall 134 of element 122, thereby to expel a quantity of pressurized air through the orifice 132 of element 122. Upon release of trigger 84, spring 92 biases piston 88, 90 outwardly of cylinder bore 94, thereby creating a sub-atmospheric pressure in cylinder bore 94. Reptition of this pumping action effects evacuation of the air from cylinder 94 and causes liquid to be drawn into cylinder bore 94 through dip tube 78, thereby to prime the pump mechanism 74 with liquid. Further actuation of the trigger 84 to reciprocate piston 88, 90 causes liquid to be pumped through check valve 120 in and through orifice 132 of foam-generating element 122 each time trigger 84 is squeezed.

The foam-generating element 122 includes a discharge opening 146, as seen in FIGS. 8 and 10, that defines a cylindrical chamber 148. Opening 146 and chamber 148 are coaxially disposed with respect to opening 136 and also with orifice 132. The end of chamber 148 remote from opening 146 terminates with a screen 150 that is interposed between chamber 148 and a coaxial slightly conical expansion chamber 152. Chamber 152 has a somewhat larger diameter than an abutting coaxial slightly conical foam forming chamber 154. Chamber 154 contains two interrupter rings 156. Rings 156, similarly to the rings 56 of the embodiment of FIGS. 4–7, are constrictions that are formed in the internal wall surface of foam forming chamber 154, and serve to agitate and homogenize the foam entering from one end of an aspirating coaxial chamber 158. Aspirating chamber 158 is closed at its other end by the transverse wall 134 in which orifice 132 is formed. Chamber 158 is provided with four wedge shaped aspirating slots 160, as seen in FIG. 10, through which air is drawn from the atmosphere through a slot 162 in body 72 of dispenser 70 by the movement of liquid therethrough from orifice 132, as forced by the dispenser pump 74.

In the operation of foam-generating element 122, reciprocation of the dispenser pump 74 forces liquid through orifice 132 into aspirating chamber 158 where it is initially aerated or mixed with air entering through slots 160 and 162. The aerated liquid product moves into foam forming chamber 154, passing interrupter rings 156 which agitate and mix the foam. From chamber 154 the foam moves on into expansion chamber 152 and through screen 150 into chamber 146 where it is molded and directed to the target.

Figure 12:
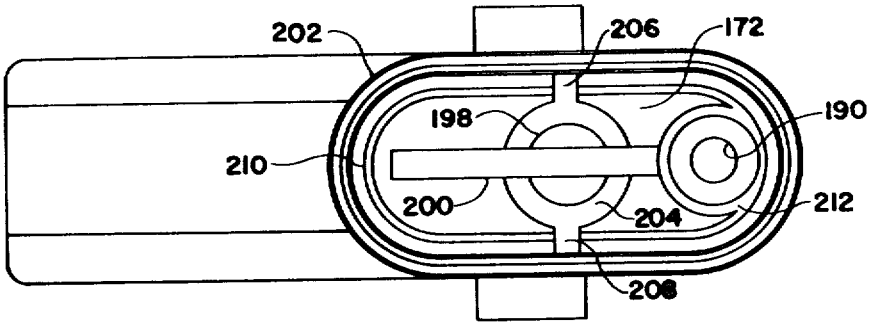
FIG. 12 is a top plan view of the component body portion of the dispenser of FIG. 11, showing the valve housing with the cover removed.
Figure 13:
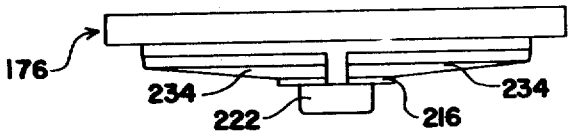
FIGS. 13 and 14 are side elevational and bottom plan views, respectively, of the valve housing cover.
Figure 14:
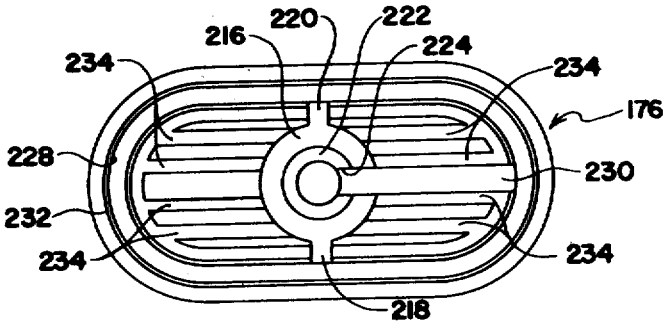
Figure 15:
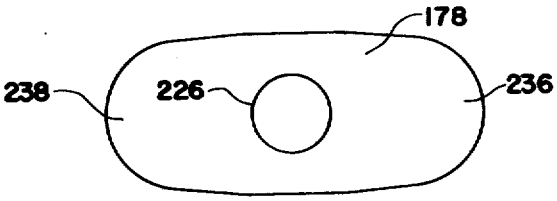
FIG. 15 is a top plan view of the flat pliable valve element employed in the valve housing.

FIGS. 11–15 illustrate an embodiment of the invention in which the internal structure of the preferred form of foam-generating element, as shown in FIGS. 4–7, is incorporated within the molded structure of a horizontally actuated bellows pump sprayer or dispensing device 164. Dispensing device 164 is of the type disclosed and claimed in copending application Ser. No. 862,257, filed Dec. 19, 1977 the disclosure of which by reference is included herein, and includes, as shown in FIG. 11, a fairing of shroud 166, a hollow compressible bellows pump 168, a component body 170 having an upwardly extending generally race track shaped opening or cavity forming a valve housing 172, as seen in FIGS. 11 and 12, and a bellows supporting hollow projection 174, and a mating component body cover 176 for the valve housing 172, as seen in FIGS. 11, 13 and 14, said cover 176 preferably being molded integrally with shroud 166 as a single member of rigid plastic. The valve housing 172 includes a flat pliable generally race track shaped valve element 178, a top plan view of which is shown in FIG. 15, that is clamped between body 170 and cover 176.

The dispensing device 164 also includes an outlet bore 180 in which the aforementioned preferred form of foam-generating element indicated at 182 and a spinner member 183 are positioned. The dispensing device 164 further includes a trigger lever 184, a dip tube 186, an inlet conduit 188 leading from the dip tube 186 to an opening 190 in the valve housing 172, and a bottle cap 192 that threads on to the upper end of a container (not shown) of fluid product to be foamed.

The foam-generating element 182 may be substantially similar in structure to the foam-generating element illustrated in FIGS. 4–7 and is positioned in close fitting relation in the outlet bore 180 of dispensing device 164 with a shoulder 194 on element 182, as seen in FIG. 11, in abutting relation with the end of bore 180 and retained in place by a flexible tab 185 on element 182 in engagement with depression 187 in the lower surface of outlet bore 180.

The spinner member 183 may be substantially similar to the member 120 illustrated in FIGS. 8 and 9, and is associated with foam-generating element 182 in outlet bore 180 in a manner similar to that in which the member 120 of FIG. 8 is associated with the foam-generating element 122. Thus, the closed end of member 183 is associated with and extends into the end 191 of foam-generating element 182, the outer face of the closed end of member 183, when in its extreme position to the left, effecting a liquid tight seal against a depressed surface 193 in the transverse wall 195 of element 182, as seen in FIG. 11. The open end of member 183, when in its extreme position to the right in bore 180, engages an inner wall surface 197 of sidewall 202 of valve housing 172. The open end of member 183 may be configured to conform in shape to that of wall surface 197 if it is desired to effect such engagement in liquid tight manner. Such liquid tight engagement is not necessary in the apparatus arrangement of FIG. 11 since the valve housing 172 includes separate provisions to be described for controlling the flow of liquid from the valve housing 172 to the outlet bore 180.

The component body 170 includes an L-shaped centrally located passageway 196 that connects the interior of the bellows supporting projection 174 with an opening 198 in the valve housing 172, as may be seen particularly by reference to FIGS. 11 and 12. Passageway 196 and opening 198 are common to the inlet and outlet passageways in the device 164, as will be described further hereinafter. The opening 198, as shown in FIG. 12, connects with a passageway or groove 200 in the bottom of the valve housing 172, as seen in FIG. 12. The groove 200 extends centrally of the valve housing 172 for a substantial portion of the length thereof, from a position near inlet opening 190 to a position near the elliptically shaped sidewall 202 of the valve housing 172. The groove 200, as shown, intersects the centrally located opening 198 and a raised sealing ring or boss element 204 formed on the bottom surface of the valve housing 172. Raised sealing or boss elements 206 and 208 radiate from the sealing ring 204, extending in opposite directions to the sidewall 202 of the valve housing 172, intersecting near the sidewall 202 with a race track shaped ring or boss element 210 that encircles the interior of the housing 172 adjacent wall 202. The depth of element 210 is uniformly less than that at the elements 206 and 208 at their positions of intersection. A further sealing ring or boss element 212 is formed on the bottom surface of housing 172 around the inlet opening 190. Boss 212 forms a valve seat for inlet opening 190. A hole formed in the sidewall 202 near the bottom thereof, and aligned with the groove 200 and the inlet opening 190, provides an outlet 214 from the valve housing 172, to the outlet bore 180 of the dispensing device 164. That half of the boss element 210 adjacent outlet opening 214 forms a valve seat for the opening.

The flat pliable valve element 178, as shown in FIG. 15, is a thin plastic membrane having smooth upper and lower surfaces and desirably, may be formed as by machine stamping from a sheet or roll of suitable plastic film. Valve element 178 is captured in clamped sealing relation between the ring boss 204 and radiating boss elements 206 and 208 on the lower surface of valve housing 172 and a sealing ring or boss 216 and radiating sealing ring or boss elements 218 and 220 formed on the lower surface of the valve housing cover 176, around a hollow projection 222 formed on and extending downwardly from the cover 176 as shown in FIGS. 13 and 14. Projection 222 has a slot 224 formed in the sidewall thereof extending for substantially the full length of the projection 222. Projection 222 extends through an opening 226 in valve element 178 into the centrally located opening 198 in the bottom surface of valve housing 172 when valve element 178 is clamped in place.

The valve housing cover 176 has the same generally race track shape as the valve housing or cavity 172 and further is provided with a peripheral downwardly depending flange 228 that embraces and encircles the outer wall 202 of the valve housing 172 when cover 176 is secured in place on component body 170. Desirably cover 176 is secured to body 170 by ultrasonic welding or other suitable bonding means.

A passageway or groove 230 on the lower surface of the cover 176 connects with slot 224 in the wall of downwardly depending projection 222 and extends centrally of the cover lower surface to an elliptically or race track shaped ring or boss element 232 that is spaced from the flange 228, the groove 230 intersecting boss 232, also. As may be seen particularly in FIG. 11, the groove 230 extends in the direction of and terminates above the inlet opening 190 in the valve housing 172.

Several outwardly and upwardly tapering ribs, all designated by the numeral 234, as seen in FIGS. 13 and 14, are provided on the lower surface of cover 176 to provide space for the opposite end portions 236 and 238 of the flat valve element 178 to lift up or unseat, respectively, from the boss 212 around the inlet opening 190 and the boss 210 adjacent the outlet opening 214 in the wall 202 at the other end of the valve housing 172. Additionally, the ribs 234 limit the extent to which the end portions 236 and 238 of the valve element 178 may be lifted off their associate valve seats, and provide support for valve element 178 end portions 236 and 238 in their lifted positions.

Since the valve housing 172 includes separate valve means for controlling the flow of liquid through the outlet opening 214, specifically valve element end portion 238 and the boss 210 adjacent the outlet opening 214, it is not necessary, as previously mentioned, for the spinner element 183, in its extreme position to the right as seen in FIG. 11, to effect a liquid tight seal. Furthermore, as those skilled in the art will understand, it is not then necessary for the spinner element 183 to have a capability of sliding to the left and right in outlet bore 180 of the dispenser component body 170. As a result, if desired, the spinner element 182 may be molded integrally with component body 170 within the outlet bore 180, employing known molding techniques. Such integral molding of spinner element 183 with the component body 170 simplifies handling and assemblage of the components, and effects a desirable reduction in manufacturing cost of the apparatus.

Compressible bellows 168, as seen in FIG. 11, is sealed or closed at one end 240, and is open at the other end 242. Bellows 168 is of a unitary, blow molded construction, a preferred form being the elastomeric compressible bellows shown, and has multiple flexible wall sections or corrugations 244 that enclose a pump chamber 246.

The open end 242 of bellows 168 is provided with a narrowed neck 248 that receives the projection 174 of component body 170 in sealing relation. Neck 248 has an inwardly tapered integral narrow flange or lip on the open end thereof that cooperates with inwardly formed tabs on component body 170 for retaining bellows 168 on the projection 174. Desirably, four such tabs (not shown) spaced 90° apart are provided.

Compressible bellows 168 is further supported on component body 170 within a cylindrical member 250 that is formed integrally with component body 170. A platform or disc 252 is provided in member 250, in edge sliding engagement with the inner wall thereof, and desirably ultrasonically welded to the closed end wall 240 of bellows 168. An extension 254 of trigger lever 184 is connected to platform 252. An upper trigger extension 256 and a lower trigger extension 258 are provided to guide trigger 184 in a straight or linear path when depressed. Upper trigger extension is slidingly received in a slot 260 in the lower wall adjacent outlet bore 180 of component body 170. Similarly, lower trigger extension 258 is slidingly received in a slot 262 in the lower surface of cylindrical member 250. As shown, trigger 184, trigger extensions 254, 256 and 258, and platform 252 preferably are integrally formed as a single member of rigid plastic.

In the operation of the invention embodiment of FIGS. 11–15, fluid dispensing device 164 is attached to a container (not shown) of fluid product to be foamed by screwing cap 192 onto the upper portion or neck of the container. The dispensing device 164 is actuated by depressing 254 and platform 252 against the closed end 240 of bellows pump 168, applying a compressive stress on the latter. As bellows pump 168 is compressed, the length of the bellows 168 is substantially diminished, the volume of pump chamber 246 is substantially decreased and a pressure is generated in pump chamber 246 that is substantially higher than the ambient or atmospheric pressure.

Initially, only air is present in chamber 246 and the pressure increase thereof is transmitted by common passageway 196, opening 198 and the opening in hollow projection 222, slot 224 and the groove 230 in the lower surface of cover 176 to the space above the end portion 236 of the flat valve element 178. Such pressure increase forces the end portion 236 of the valve element 178 into sealing engagement with sealing ring or boss element 212 thereby closing the inlet opening 190. Simultaneously, the increase in pressure in pump chamber 246 is transmitted by common passageway 196, opening 198 and groove 200 to the lower side of the portion 238 of the valve element 178 adjacent the outlet opening 214 in the valve housing sidewall 202, thereby causing the valve element portion 238 to lift off the bosss element 210 adjacent the outlet opening 214 of the housing 172. Air in pump chamber 246 and passes through opening 214 into bore 180, compressing the air therein to cause spinner member 183 to slide to the left and to seat against the face 193 of wall 195, thereby to expel a quantity of air through orifice 264 of foam-generating element 182.

Upon release of trigger lever 184, the inherent elastic memory of the elastomeric flexible wall sections, or corrugations of the bellows pump 168 causes the latter to expand to its original expanded configuration, returning the trigger lever 184 at the same time, to its original position, as shown in FIG. 11, the trigger extension members 256 and 258 guiding the movement of the trigger 184. This return expanding action of the bellows pump 168 develops a partial vacuum in the pump chamber 246, a pressure lower than atmospheric pressure that is transmitted by common passageway 196 and opening 190 and groove 200 to the space beneath the outlet portion 238 of valve element 178 adjacent outlet opening 214. This brings the valve element portion 238 down into sealing engagement with the sealing ring or boss element 210, thereby closing the outlet opening 214. Simultaneously, the reduced pressure in pump chamber 246 is transmitted by common passageway 196 and opening 198 and the opening and slot 224 is projection 222 to the space above the inlet portion 236 of the valve element 178, adjacent the inlet opening 190. This space, as previously noted, is sealed by the valve element 178 clamped between ring boss elements 204 and 216 and the radiating boss elements 206, 208 and 218, 222 from the space above the outlet opening 214. As a result, the portion 236 of the valve element 178 above the inlet opening 190 is lifted off the boss 212 allowing liquid to be drawn into pump chamber 246 from the container holding the supply of liquid product to be foamed, through the dip tube 186, inlet conduit 188, inlet opening 190, and passageway 196, filling pump chamber 246 with a charge of liquid to be foamed.

On the next and subsequent depressing operations of trigger lever 184, the liquid in pump chamber 246 becomes pressurized by the compressively stressed bellows pump 168 which forces the portion 236 of valve element 178 adjacent inlet opening 190 into sealing engagement with sealing ring or boss element 212, closing the inlet opening 190. Simultaneously, the portion 238 of valve element 178 adjacent the outlet opening 214 is lifted off sealing ring or boss element 210, as above described, and allows liquid to flow through opening 214 into the outlet bore 180, through the annular space around member 183 and forced through tangential slots and a cavity such as slots 130 and cavity 128 in FIG. 9, and on through orifice 264, as seen in FIG. 11 to be foamed by and discharged as a foam by foam-generating element 182.

During the above described pumping and dispensing operation of the dispensing device 164, the fluid level in the container is lowered as fluid is dispensed or sprayed. This causes a partial vacuum to develop in the container unless venting thereof is provided. Those skilled in the art will understand that various arrangements to provide such venting are known in the prior art and may be adopted for use with the dispensing device of the present invention, as desired. For example, venting means comprising a gasket associated with the bottle closure cap 192 may be provided, as illustrated in FIG. 8 hereof.

Foam-generating element 182 in the foam dispenser embodiment of the invention shown in FIG. 11, as noted, is substantially identical in construction to the foam-generating element illustrated in FIGS. 4–7. In the operation of this invention embodiment, reciprocation of the bellows pump 168 by stroking or squeezing trigger 184 forces liquid through orifice 264 of element 182, as a conical spray, into an aspirating chamber 266 where it is initially mixed with air entering through slots 268 of element 182 and adjacent slots 270 and 272 provided, respectively, in the shroud 166 and in the outlet bore 180 of dispenser body 170. The aerated liquid product moves into a foam forming chamber 274, passing interrupter rings 276 which agitate and mix the foam, and moves on through an expansion chamber 278 and screen 280 into chamber 282. In chamber 282 the foam is molded and directed to the target.

As those skilled in the art understand, plastics suitable for molding the components of the dispenser or sprayer of each of FIGS. 8–10 and FIG. 11 are thermoplastic materials such those mentioned herein for fabricating the foam-generating elements of FIGS. 1–7. Polytetramethylene terephthalate (PTMT) may also be employed.

In the preferred embodiment of the foam-generating element according to the invention, as described, the diameter or cross section of the expansion chamber preferably is substantially larger than the diameter or cross section of the foam forming chamber, as illustrated particularly in the apparatus embodiments of FIGS. 1–3 and FIGS. 4–7 and 11, although for some applications an expansion chamber of somewhat relatively smaller diameter or cross section may be suitable, as illustrated in FIG. 8. It will be understood that, if desired, the foam-generating elements employed within the confines of the molded structure of the dispensers of FIG. 8 may have the configuration of the preferred foam-generating element illustrated in FIGS. 4–7 and 11; also, a foam-generating element is illustrated in FIGS. 1–3 may be employed in the molded structure of each of FIGS. 8 and 11, if desired.

Thus, there has been provided according to the invention a very compact foam-generating element in which foam of high quality is produced in a short axial distance comprising the combination of a foam forming means on the upstream side of an expansion chamber, screen means terminating the downstream side of the expansion chamber, and outlet means for dispensing the foamed product. The foam-generating element has been demonstrated as being useful with piston-type or bellows type dispensers either as a nozzle attachment to the dispenser outlet or head, or as integrated within the confines of or mold structure of the dispenser. The liquid product passes as a spray from the dispenser through an orifice into a cylindrically shaped aspirating or air mixing chamber, fans out, and strikes interrupter rings formed on the inner wall of a foam forming chamber. Just prior to striking the interrupter rings the liquid jet is impinged upon by a plurality of columns of air that are aspirated into the aspirating chamber where preliminary foaming begins. After such initial foaming, the product is controlled and compacted in the foam forming chamber by the interrupter rings and then moves through the expansion chamber where the foaming action is increased, being facilitated and the time of treatment extended by the screening means that terminate the downstream side of the expansion chamber. The foam moves on through the screening means which serves also to improve the foam by breaking it up into smaller bubbles thereby providing a foam that is characterized by a tightly packed, finer textured even consistency. From the screening means the foam moves through a turbo chamber that directs the foam toward the target.

What is claimed is:

1. A foam-generating element which comprises a body adapted at one end to receive liquid pumped from a trigger-type dispenser and at the other end to dispense foamed product, including (a) a first chamber within the body for mixing said liquid with air, (b) one or more air passages for introducing air into said first air chamber, (c) a second chamber adjacent said first chamber, through which the aerated liquid passes, the second chamber being of substantially the same diameter as said first chamber and being provided with means for mixing the foam, (d) a third chamber adjacent to and of larger diameter than said second chamber and which receives aerated product from said second chamber, (e) screening means covering the downstream end of said third chamber, through which the product of the third chamber is forced, and (f) outlet means for dispensing the foamed product.

2. A foam-generating element which comprises a body means adapted at one end to receive liquid pumped from a liquid dispenser and at the other end to dispense foamed product, including (a) a first chamber within the body means wherein said liquid is mixed with air, (b) a second chamber adjacent said first chamber through which said aerated liquid passes, the second chamber being of substantially the same cross section as said first chamber, (c) a third chamber adjacent to and of larger cross section than the second chamber and which receives aerated product from said second chamber, (d) screening means covering the downstream end of said third chamber and through which the product in the third chamber is forced, and (e) outlet means for dispensing the foamed product.

3. A foam-generating element which comprises a body means adapted at one end to receive liquid pumped from a liquid dispenser and at the other end to dispense foamed product, including (a) a first chamber within the body means wherein said liquid is mixed with air, (b) a second chamber adjacent said first chamber through which said aerated liquid passes, the second chamber being of substantially the same or lesser cross section than said first chamber, (c) a third chamber adjacent to and of larger cross section than the second chamber and which receives aerated product from said second chamber, (d) said first, second and third chambers having a common axis, said first chamber including in a wall adjacent said one end of said body means an orifice from which said liquid is pumped in the form of a spray by said dispenser, the axis of said spray of liquid being substantially coincident with said common axis, the cross sections of said first and second chambers transverse of said axis being substantially the same, and transverse of said axis said third chamber having a larger cross section than said second chamber, (e) screening means covering the downstream end of said third chamber and through which the product in the third chamber is forced, and (f) outlet means for dispensing the foam product.

4. The foam-generating element of claim 3 in which said first chamber is provided with a plurality of slots in other walls thereof, said slots being wedge-shaped and extending in a direction transverse to said common axis, the narrow edge of said slots being in the inner wall of said first chamber whereby to effect an increase in the velocity and turbulence of the air drawn through said slots into said chamber by the movement of said spray of liquid and facilitation of the mixing of said liquid and air to cause preliminary foaming in said first chamber.

5. A foam-generating element comprising a body means adapted at one end to receive liquid pumped from a trigger-actuated liquid dispenser and at the other end to dispense foamed product, said foam-generating element including within said body means (a) foam-generating means for mixing air with said liquid to produce foam, (b) foam enhancing means including an expansion chamber and a nozzle at the inlet to said expansion chamber to receive foam generated by said foam-generating means, said expansion chamber having a downstream opening, (c) screening means covering the downstream opening of said expansion chamber, and (d) an outlet conduit for dispensing the foamed product.

6. A foam-generating element as specified in claim 5 wherein said screening means tends to function as an obstacle to induce an upstream flow of a peripheral portion at least of the foam in said expansion chamber, and wherein said expansion chamber includes means for entraining said upstream directed foamed portion with the central downstream flow of foam therein whereby the period of time of foaming action in the expansion chamber for said foamed portion is extended and the quality of the foamed product is improved.

7. A foam-generating element as specified in claim 6 wherein the cross section of said outlet conduit is at least as large as the cross section of the downstream opening of said expansion chamber.

8. A foam-generating element as specified in claim 6 wherein said foam-generating means includes a foam forming chamber, wherein the transverse cross section of said expansion chamber is substantially larger than the transverse cross section of said foam forming chamber, and wherein said expansion chamber includes an upstream extending peripheral portion that encircles said foam forming chamber.

9. A foam-generating element as specified in claim 8 wherein said foam-generating means further includes an aspirating chamber into which air is introduced for mixing with said liquid.

10. A foam-generating element as specified in claim 9 wherein said aspirating chamber includes one or more wedge-shaped sharp-edged radial slots in its walls through which air is introduced for mixing with said liquid.

11. A foam-generating element as specified in claim 10 wherein said foam forming chamber includes interrupter rings formed in the wall thereof for agitating and homogenizing the mixture of liquid and air entering therein from said aspirating chamber.

12. A foam-generating element as specified in claim 9 wherein said aspirating chamber includes an orifice in a wall thereof adjacent said one end of said body means, said orifice having an axis and adapted to form along said axis in said aspirating chamber a spray of liquid, wherein said foam forming chamber has an axis generally coincident with the axis of said orifice, the cross sections of said aspirating chamber and said foam forming chamber transverse to said axis being substantially the same, whereby said spray of liquid passes into said foam forming chamber substantially unimpeded by the interface of said aspirating and foam forming chambers.

13. A foam dispenser comprising a body member in or to which the other components of the dispenser are retained or secured, a pump means in said body member for pumping and pressurizing liquid, inlet and outlet means in said body member for the delivery of liquid to and the discharge of liquid from said pump means, said outlet means including an outlet bore to which liquid pressurized by said pump means is delivered, trigger means secured to the body member for actuating said pump means, and a foam-generating element located substantially wholly within said outlet bore, said element comprising a body means adapted at one end to receive liquid pumped by said pump means and at the other end to dispense foamed product.

14. A foam dispenser as specified in claim 13 wherein said body means of said foam-generating element includes foam forming means for mixing air with liquid pumped by said pump means and received at said one end of said foam-generating element to produce foam, an expansion chamber having an upstream opening for receiving foam-generated by said foam-generating means, and having a downstream opening, screening means covering the downstream opening of said expansion chamber, and an outlet conduit for dispensing the foamed product out of the other end of said body means, said outlet conduit receiving foam forced through said screening means from said expansion chamber when said pump means is actuated by said trigger means.

15. A foam dispenser as specified in claim 14 wherein said screening means of said foam-generating element tends to function as an obstacle to induce an upstream flow of a peripheral portion at least of the foam in said expansion chamber, and wherein said expansion chamber includes means for entraining said upstream directed foamed portion with the central downstream flow of foam therein whereby the period of time of foaming action in the expansion chamber for said foamed portion is extended and the quality of the foamed product is improved.

16. A foam dispenser as specified in claim 15 wherein said foam forming means of said foam-generating element includes a foam forming chamber, wherein the transverse cross section of said expansion chamber is substantially larger than the transverse cross section of said foam forming chamber, and wherein said means for entraining said upstream directed foamed portion includes a nozzle formed at the inlet to said expansion chamber.

17. A foam dispenser as specified in claim 16 wherein said foam forming means of said foam-generating element includes an aspirating chamber into which air is introduced for mixing with said liquid.

18. A foam dispenser as specified in claim 17 wherein said aspirating chamber of said foam forming means is formed with one or more wedge-shaped sharp-edged radial slots in its walls through which air is introduced for mixing with said liquid.

19. A foam dispenser as specified in claim 18 wherein said foam forming chamber of said foam-generating means includes interrupter rings formed in the wall thereof for agitating and homogenizing the mixture of liquid and air entering therein from said aspirating chamber.

20. A foam dispenser as specified in claim 13 wherein said pump means includes a variable volume pump chamber, and said inlet and outlet means each include an actuatable control valve means.

21. A foam dispenser as specified in claim 20 wherein said variable volume chamber of said pump means is constituted by a piston and cylinder.

22. A foam dispenser as specified in claim 21 wherein said control valve means in said inlet means comprises a check valve and said control valve means in said outlet means comprises a combination spinner and check valve.

23. A foam dispenser as specified in claim 20 wherein said variable volume chamber of said pump means is constituted by a hollow resilient pump member that is adapted to be compressed and comprises a bellows member having a sealed end, flexible corrugated walls, and an open end in engagement with said body member.

24. A foam dispenser as specified in claim 23 wherein said control valve means of said inlet and outlet means are included within an internal cavity in said body member, said cavity being open on its upper end and closed by a cover plate having means cooperating with said body member to separate said inlet means from said outlet means and including a pliable valve element captured between said cover plate and said body member, said valve element having an inlet portion and an outlet portion each of which portions seals against an individually associated portion of the surface of said cavity to close said inlet means and said outlet means, respectively.

25. A foam dispenser as specified in claim 23 wherein said foam-generating element includes (a) a first chamber within said body means wherein said liquid pumped by said pump means is mixed with air, (b) a second chamber adjacent said first chamber through which said aerated liquid passes, said second chamber being of substantially the same diameter as said first chamber, (c) a third chamber adjcent to and of larger diameter than said second chamber and which receives aerated product from said second chamber, (d) screening means covering the downstream end of said third chamber and through which the product in the third chamber is forced, and (e) outlet means for dispensing the foamed product.

26. A foam dispenser as specified in claim 25 wherein said first chamber of said foam-generating element is provided with one or more wedge-shaped slots for introducing air into said chamber, wherein said first and second chambers are cylindrical in form and said first chamber has a diameter that is at least as great as that of said second chamber, and wherein said second chamber is provided with means for agitating or mixing the aerated product of said first chamber.

27. A foam dispenser as specified in claim 26 wherein said body member of said foam dispenser is provided with a slot for introducing air into said first chamber.

28. A foam dispenser as specified in claim 13 including spinner means positioned in said outlet bore between said pump means and said one end of said foam generating element.

29. A foam dispenser as specified in claim 24 including spinner means positioned in said outlet bore between the outlet portion of said valve element and said one end of said foam-generating element, said spinner means being fixed in position.

30. A foam dispenser as specified in claim 29 wherein said spinner means are molded integrally with said body member.

* * * * *